United States Patent [19]

Albin

[11] 4,401,032

[45] Aug. 30, 1983

[54] VERTICAL INK METERING APPARATUS

[75] Inventor: Scott R. Albin, Hockessin, Del.

[73] Assignee: Remington Arms Company, Inc., Bridgeport, Conn.

[21] Appl. No.: 368,266

[22] Filed: Apr. 14, 1982

Related U.S. Application Data

[62] Division of Ser. No. 212,012, Dec. 1, 1980, Pat. No. 4,384,518.

[51] Int. Cl.[3] ..... B41F 31/00

[52] U.S. Cl. ..... 101/363; 101/426; 101/DIG. 8; 101/DIG. 14

[58] Field of Search ..... 101/363, 350, 35, 36, 101/37, 425, 426, DIG. 8, DIG. 14; 118/261

[56] References Cited

U.S. PATENT DOCUMENTS

| | | | |
|---|---|---|---|
| 1,190,640 | 7/1916 | Graham | 101/350 |
| 2,109,590 | 3/1938 | Kimball | 101/35 |
| 2,442,102 | 5/1948 | Tenety | 101/40 X |
| 2,788,740 | 4/1957 | Hirschey | 101/350 |
| 2,818,016 | 12/1957 | Alessi, Jr. et al. | 101/350 X |
| 2,927,532 | 4/1960 | Persson | 101/350 X |
| 2,945,436 | 7/1960 | Van Buskirk | 101/350 |
| 3,405,633 | 10/1968 | Price, Jr. et al. | 101/37 |
| 3,408,934 | 11/1968 | Clausen | 101/425 |
| 3,422,758 | 1/1969 | Brewster | 101/425 |
| 3,587,820 | 6/1971 | Lachaussee | 198/22 |
| 3,593,836 | 7/1971 | Hill | 198/25 |
| 3,610,149 | 10/1971 | Sebranice et al. | 101/352 |
| 3,630,146 | 12/1971 | Shields | 101/351 |
| 3,709,048 | 1/1973 | Stepanek et al. | 74/53 |
| 3,822,639 | 7/1974 | Szpitalak | 101/40 |
| 3,903,793 | 9/1975 | Schubert | 101/351 |
| 3,929,066 | 12/1975 | Pillon | 101/35 |
| 4,003,308 | 1/1977 | Decker | 101/351 |
| 4,007,682 | 2/1977 | Gundlach | 101/348 |
| 4,078,483 | 3/1978 | Gall | 101/44 |
| 4,117,800 | 10/1978 | Maus et al. | 118/261 X |
| 4,152,985 | 5/1979 | Welborn | 101/352 |
| 4,184,429 | 4/1980 | Widmer | 101/169 |

FOREIGN PATENT DOCUMENTS

| | | | |
|---|---|---|---|
| 1088413 | 9/1960 | Fed. Rep. of Germany | 118/261 |
| 1130312 | 10/1968 | United Kingdom . | |

*Primary Examiner*—Clifford D. Crowder

*Attorney, Agent, or Firm*—Nicholas Skovran; William L. Ericson; Barry Estrin

[57] ABSTRACT

Dry offset printing apparatus for high speed printing on cylindrical objects fed either horizontally or vertically to the printer, which comprises a three-roller system including a single roll ink-metering system, plate cylinder and blanket or p rint roll. The ink roll is provided with a relatively soft, smooth elastomeric surface as is also the offset print roll blanket. A doctor blade is configured and oriented with respect to the ink roll to meter a uniformly even, thin film of ink onto the roll. Means are provided for evenly distributing the ink film on the ink roll in both horizontal and vertical embodiments of the printer. Means are also provided to prevent excessive ink buildup on print roll when skips occur at the printing station. Rotary transfer means are provided for positively feeding the cylindrical objects to the printer at high speeds in either horizontal or vertical orientation.

7 Claims, 18 Drawing Figures

VERTICAL INK METERING APPARATUS

This is a division of application Ser. No. 212,012, filed Dec. 1, 1980, now U.S. Pat. No. 4,384,518.

BACKGROUND OF THE INVENTION

1. Field of the Invention

The present invention relates to an improved offset printer, and more particularly to an improved apparatus for high speed feeding and printing on cylindrical objects.

The present invention is particularly suitable in the manufacture of cylindrical containers, such as shotshell ammunition, where printing on the surface of corrugated, plastic cylindrical shells must be accomplished economically in a continuous run at relatively high speeds, interface readily with other high speed equipment in an automated manufacturing process, and yield acceptable high quality print appearance. While the invention disclosed herein is described generally in connection with shotshell ammunition manufacture, it will be readily apparent and is to be understood that the printing apparatus of the present invention can be used wherever high speed and quality printing on cylindrical objects, such as cans or other types of containers, is a desired goal.

2. Description of the Prior Art

High speed, yet economical, printing of acceptable quality is of particular concern in shotshell manufacture where present production techniques produce shells at very high rates. Quite obviously, printing apparatus unable to produce acceptable quality print on the cylindrical corrugated surface of the shell at the same output rate as the other manufacturing equipment defeats the economics of high speed automated production.

Prior art printing apparatus for shotshell printing has included conventional letterflex printers and hot stamp printers. The latter type generally produce very high quality print by means of a heated shell logo die used to print a pigmented carrier film firmly against the cylindrical shell surface. Crisp, clear letters which adhere well to the corrugated plastic surface are formed on areas where the hot die contacts the carrier film. Disadvantages of the hot stamping process include prohibitively high cost and low speed. The cost is approximately four times that of ink printing and the speed is severely limited by the time required for heat transfer. The speed required in high speed shell manufacture, however, is beyond the capability of present hot stamp printers.

Letterflex printers employed in shotshell printing, although not generally speed limited, produce print of low quality. The characters are often sloppy, distorted and smeared.

An example of such a conventional letterflex printer is schematically illustrated in FIG. 1. Paste-type ink is applied to the printing surface by a print roll 10. The latter is supplied with ink through continuous rolling contact with an ink roll 12. The print roll 10 includes a flexible printing plate or stamp 14 of rubber or composition material having a backward reading raised image. Ink applied to the raised surface by the ink roll 12 is transferred by direct contact of the flexible stamp 14 to the surface to be printed. In such printers, the plate is very sensitive to the thickness of the ink applied by the ink roll so that if the latter carries an ink film that is not uniform the resulting printed image will exhibit such non-uniformities present.

The prior art letterflex printer of FIG. 1 is shown printing on the corrugated surface of loaded shotshell ammunition at a point near the end of the production cycle. Shells 16 from a standard loader apparatus (not shown) are dropped into pockets of an indexing conveyor belt 18 which must stop intermittently to accommodate the printing operation. During the conveyor dwell, the shell at the printing station is lifted out of the belt by rollers 20 so as to be contacted and rotated by the print roll 10. A film of ink from the supply fountain 22 is deposited on an ink roll 12, which is formed of hardened steel, by an adjustable wiper blade 24. The ink is then transferred to the rubber stamp 14 on the print roll, which in turn transfers the ink image to the corrugated rib surface of the shell as the stamp rotates into direct contact with the shell.

The ink metering system of FIG. 1 has several disadvantages in addition to those described above. Ink 25 is applied through the small clearance gap between the hardened steel ink roll 12 and the wiper blade 24. These rigid boundaries are prone to severe streaking. Even minute lint and dust particles collecting at this point will form streaks in the ink film supplied to the ink roll. Moreover, the amount of ink released and applied to the roll varies greatly, due to the inability of accurately positioning the wiper blade relative to the ink roll.

The direct letterflex printing technique is also not well suited for this particular application due to the deeply corrugated surface of the shells. As shown in the magnified insert of FIG. 1A, a soft, compliant stamp is necessary to conform to the corrugated surface 16A in order to obtain complete printing on the surface. Such a stamp, however, has poor character definition and is subject to severe wear, and its durability is sharply reduced by the continuous printing operation. Moreover, the corrugated shells are unevenly rotated when driven by the hard surface portion of the steel print roll. This uneven rotation is further exaggerated by the stamp protruding from the print roll, resulting in speed differential which abruptly jolts the shell, causing smearing of the printed image.

Additional disadvantages in the above-described printing apparatus are due to the non-positive nature of its shell feeding. In the feeding mechanism shown in FIG. 1, shells from the standard loader (not shown) simply roll down a feed track 26 toward the indexing conveyor belt 18. A swinging door 28 in the area at the exit of the track provides the only means available for urging the shell into proper orientation in a pocket of the conveyor. This lack of positive feed control results in feed jams and skips.

Feed jams occur when the shell slips around sideways out of the conveyor pocket. Such jams are caused by a sudden jolt from the moving belt and will create a domino effect along the indexing conveyor. Jams can also severely damage the print roll.

Skips, on the other hand, occur when a shell does not fall into a pocket each time the conveyor belt indexes. Skips cause excessive ink build-up on the print roll, since the ink roll is continually applying ink to the former, which is not in turn transferring the applied ink due to the absence of a shell at the printing station. As a result, the next shell fed to the printing station after the skip will be contacted by the stamp with excessive ink, causing unclear, filled-in print image of generally poor quality.

Prior efforts have been made to solve some of the aforementioned deficiencies associated with offset printing by, for example, providing numerous rollers to uniformly distribute the ink onto the ink roll in order to form a continuous film for transfer to the offset roller. Such ink metering systems are commonly found in newspaper printing presses and are quite complex. They may include, for example, a fountain roll, a reciprocating ductor roll, and several distribution rolls to evenly apply the ink film onto a form roll, which in turn inks a plate cylinder carrying the image to be printed. Still others have included complex speed-reduction mechanisms for dealing with skips whereby, for example, the printer and/or the conveyor belt will completely stop when a skip occurs. Quite obviously, such equipment greatly reduces speed and increases costs, thus severely affecting the output of a high speed automated production process.

SUMMARY OF THE INVENTION

It is an object of the present invention to avoid and overcome the above-mentioned drawbacks and disadvantages associated with prior industrial printing equipment for cylindrical containers, such as shells, by providing new and improved dry offset printing and positive feed techniques which, particularly when used in combination with high speed automated production apparatus, will greatly improve the appearance of the ink print yet be capable of sustaining reliable high speed operation.

It is a further object of the present invention to provide an improved dry offset printer suitable for either horizontal or vertical printing on cylindrical objects.

Another object of the present invention is to provide a simple offset printer comprising three rollers, at least two of which have relatively soft surfaces capable of producing very high quality printing at high speed on ribbed cylindrical surfaces.

Yet another object of the present invention is to provide a novel ink metering system employing a single ink roll and flexible doctor blade oriented with respect to the roll so as to meter a uniformly even thin film of ink onto the ink roll, thus eliminating the smearing and other poor qualities associated with the printed images of prior art printers.

Still another object of the present invention is to provide a vertical offset printer with a novel ink metering system for providing a uniformly even thin film of ink on a vertically oriented ink roll.

It is a further object of the present invention to provide a means for eliminating excessive ink buildup on the printing plate and blanket of an offset printer when vacancies occur at printing stations without stopping the printing operation.

Another object of the present invention is to provide a new and improved positive feeding technique for conveying cylindrical objects to the printer.

It is a further object of the present invention to provide a novel rotary feeding apparatus capable of high speed controlled transfer of cylindrical objects from a prior production station to the printing station in a manner which eliminates potential skips or jams in the transport path.

Yet another object of the present invention is to provide a positive rotary feed capable of transporting cylindrical objects from a prior production station to a printer in either horizontal or vertical orientation.

In general, these objects and others are accomplished by providing a novel offset printing apparatus comprising a three-roller system which includes ink, plate and blanket rolls oriented either horizontally or vertically, depending upon the orientation of the cylindrical objects being fed to the printer. The surface of the blanket or offset print roll is smooth and is formed of a relatively soft elastomeric material. It is soft enough to permit good contact with the surface of ribbed cylindrical containers such as shotshells with considerably less printing pressure. Longlasting printing stamps of plastic, elastomeric material, or metal are located on the plate cylinder.

The ink roll and doctor blade assembly constitute the ink metering system. The ink roll surface or covering is also of relatively soft elastomeric material to reduce streaking. A thin, flexible doctor blade is spring loaded slightly against the ink roll in what might be conveniently described as "following" rather than a "reverse angle" mounting. In the latter configuration, the doctor blade points against the direction of the ink roll rotation, while in the "following" mounting, the blade follows rotation direction. The geometry and orientation of the blade with respect to the ink roll will develop a fluid pressure sufficient to lift the doctor blade slightly, due to the interaction between the ink viscosity and the roll motion. A thin, uniform streak-free film of liquid or paste ink can thus be deposited on the ink roll without wear.

The above-described novel three-roller offset printer with single roll ink-metering system can be constructed with rolls oriented either horizontally or vertically to accommodate printing on shells being fed for printing in a similar orientation. In the horizontal embodiment, the ink roll rotates through a trough of ink which is spread evenly onto the surface of the rolls by the doctor blade along the line of contact between the two.

When vertically oriented, however, the ink supply cannot readily be positioned to permit rotation of the ink roll through the reservoir along its entire surface length prior to contact by the doctor blade due to the force of gravity on the ink. Mechanical means may be used to urge the ink up along the surface line defined by the ink roll/doctor blade contact in order to evenly distribute the ink and form the thin ink film on the roll. Such mechanical means may include a recirculating vertical pump with oscillating rubber paddle or wiper. The wiper is attached to the bottom of a vertical shaft parallel to the ink roll shaft, and disposed so that it may dip down into the ink reservoir. When the wiper shaft is driven, it rotates and oscillates vertically, causing the paddle wiper to rise and apply ink to the bottom of the ink roll. The dab of ink applied carries to the doctor blade where a puddle of ink rapidly accumulates. Fluid viscosity and relative roll velocity, as well as the pressure of the blade squeezing off the excess ink, increase fluid pressure significantly enough to cause the ink to rise vertically up the ink roll along the edge defined by the blade/roll contact to relieve this pressure. As a result, sufficient ink is applied behind the following doctor blade for it to meter a smooth, even film on the surface of the roll as in the case of the horizontally oriented metering system.

By suspending the peripheral, lower end of the ink roll into an annular ink trough, the same action can be created without the need of the recirculating ink pump. The rotation of the ink roll causes the ink in the trough to climb up the roll along the line of the doctor blade contact, thus eliminating the need for a pump. The vertical ink-metering system absent the pump is made possible by the unique configuration of the lower end of the ink roll and the trough, eliminating the need for impractical seals at the bottom of the roll to avoid ink leaks. This configuration enables only the lower, outer peripheral end portion of the ink roll to rotate through the annular trough. A simple seal block at the top of the doctor blade/ink roll intercept is the only sealing means necessary to prevent ink from going up over the top of the blade. Although vertical ink metering may therefore be easily accomplished without this pump, use of the recirculating pump may still be advantageously employed in certain circumstances and should be considered as one of the alternative embodiments of the ink-metering means of the present invention.

When an indexing conveyor belt similar to that employed in the prior art printer system of FIG. 1 is used as a means for feeding shells to the horizontally oriented printer of the present invention, a roll-deflection means may be incorporated to prevent excess ink buildup on the plate cylinder and blanket when a skip or empty nest in the conveyor belt occurs. This is accomplished by a sensing means positioned along the conveyor belt ahead of the printer which, when an empty nest in the belt is detected, produces a signal which energizes a pneumatic or hydraulic means for pushing the ink roll assembly out of contact with the plate cylinder.

Yet another technique for minimizing the effects of skips is to provide a means for removing at least part of the ink from the blanket or offset roll. This is accomplished in, for example, a vertically oriented printer, by including an excess ink removal roll in continuous rolling contact with the blanket. The excess ink removal roll is a roller bearing cylinder with a smooth, hardened outer surface in contact with and friction driven by the blanket roll. If a shell is not present, excess ink applied to the blanket roll will be transferred to the bearing surface of the removal roll as the latter rotates in contact therewith. The transferred ink is treated by solvent to dilute the ink characters on the removal roll and make the ink easier to remove. The diluted ink on the removal roll is then removed by scraping means or the like as the roll continues to rotate. The cleaned surface is then ready for further excess ink removal as the removal roll continues rotating in contact with the blanket roll.

The problem of skips and also jams can be obviated completely by the rotary transfer means designed for use with either a horizontally or vertically oriented printer. The rotary transfer means of the present invention is an improved modification of that described in U.S. Pat. No. 3,587,820 granted June 28, 1971 to M. Lachaussee. The latter discloses a transfer conveyor for feeding shotshells down a vertical tube, the upper portion of which is aligned with the axis of a rotating platform with receptacle disposed along its periphery. The lower portion of the tube is bent so that the bottom will be adjacent to the periphery of the rotating platform. The lower tube portion rotates about the platform axis so that the shells fed at the top will have the same tangential velocity as the rotating platform when deposited into the receptacles at the bottom of the tube.

The rotary transfer means of the present invention improves the concept of the aforenoted patent by providing a positive feed mechanism for rapidly transferring loaded shells (or any other type of cylindrical containers or objects) directly to the printing station in either vertical or horizontal orientation. Shells are fed into a stationary feed pipe, the entrance end portion of which may be oriented in any direction to accommodate the exit end of the prior production assembly station. The exit end portion of the pipe gradually bends to either the horizontal or vertical, depending upon the shell orientation desired at the printer. The stationary pipe ends at and aligns with a curved track which rotates about the axis of the above-mentioned fixed feed pipe. The rotary track may be disposed vertically or horizontally, again depending upon the necessary orientation of the shells being fed to the printer. The shells slide down the stationary pipe, exiting at the curved rotary track. A ledge or platform at the bottom of the curved track rotates the first shell fed at the proper height and also serves as a stop for the column of shells being fed each time the column indexes. Rails restrain the shell so that it will follow the circular arc of the rotating feed track, providing the time required for the column to advance one shell length and restraining the shell in the feed rotor as it swerves around. Other guide rails also force and guide the shell away from the circular path of the feed rotor and into the circular path of the print roll at the printing station. The shells roll against the latter rails and against the print roll as they receive the inked characters. The print roll also rotates the shells during printing and the shells continue past the printing station along the rails for subsequent collection and processing.

A further aspect of this feeder-printer assembly provides for diverging the shell flow from the printing station into two (or more) streams or columns for adaption to the downstream requirements. Usually, the next in-line operation after printing on shotshells, as well as in other types of cylindrical container manufacturing operations, is inspection and/or packing. The rate at which the cylindrical objects are fed and printed by the present invention is rapid and may not be accommodated by the subsequent operations. It may therefore be important that the printer output be divided equally into two or more lines, as may be necessary for subsequent processing. This may be conveniently accomplished, for example, by providing a diverter comprising a "paddle" attached to an arm that oscillates from side to side every cycle. The paddle is positioned adjacent to the print roll and will guide every shell alternately to the entrance of either of two vertical pipes through which they will fall for further handling and collection.

The nature and novel features which are characteristic of the present invention, as well as other objects and advantages thereof, will become more apparent from consideration of the following description taken in connection with the accompanying drawings, in which:

DESCRIPTION OF THE PREFERRED EMBODIMENTS

Figure 1:
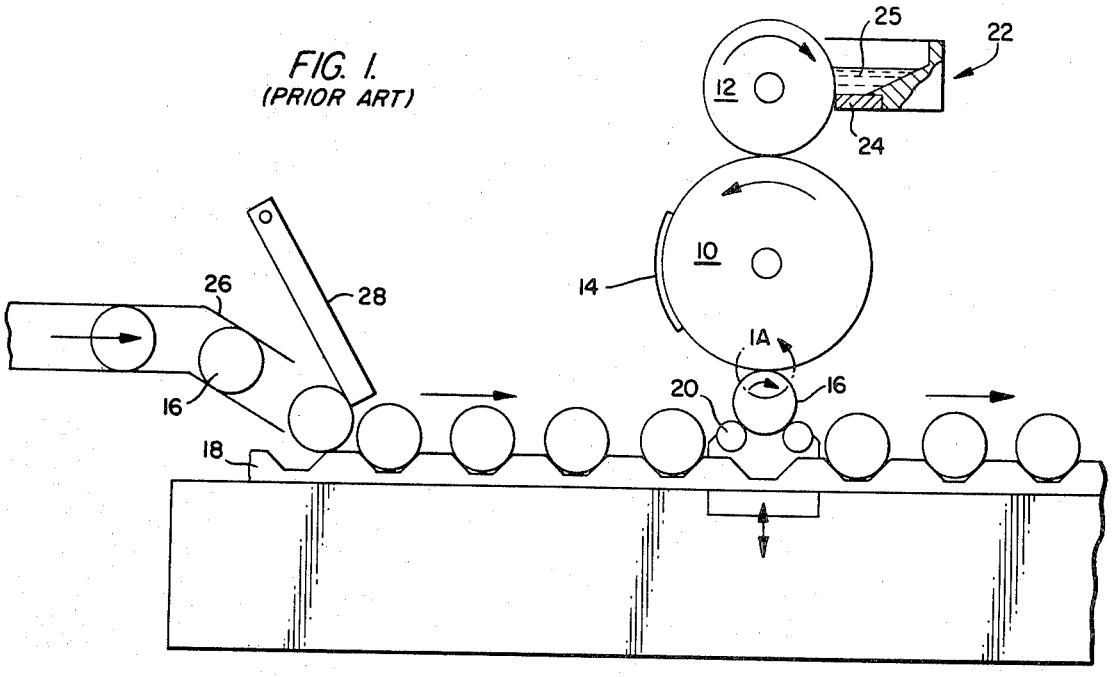
FIG. 1. (PRIOR ART)
FIG. 1 is a schematic illustration of a prior art letterflex printer with an indexing conveying belt feeder.
Figure 1A:
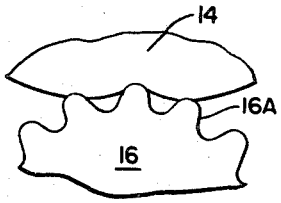
FIG. 1A is an enlarged view of the inset portion of FIG. 1 illustrating the point of contact between the print roll and the corrugated cylindrical surface of a shotshell.

Reference to the prior art letterflex printer of FIG. 1 has been made previously. A first embodiment of the present invention is illustrated schematically in FIG. 2 as an offset printer 30 oriented horizontally for printing on shotshells 16 fed to the printing station by means of an indexing conveyor belt 18 similar to that described earlier in connection with the prior art letterflex printer of FIG. 1.

Figure 2:
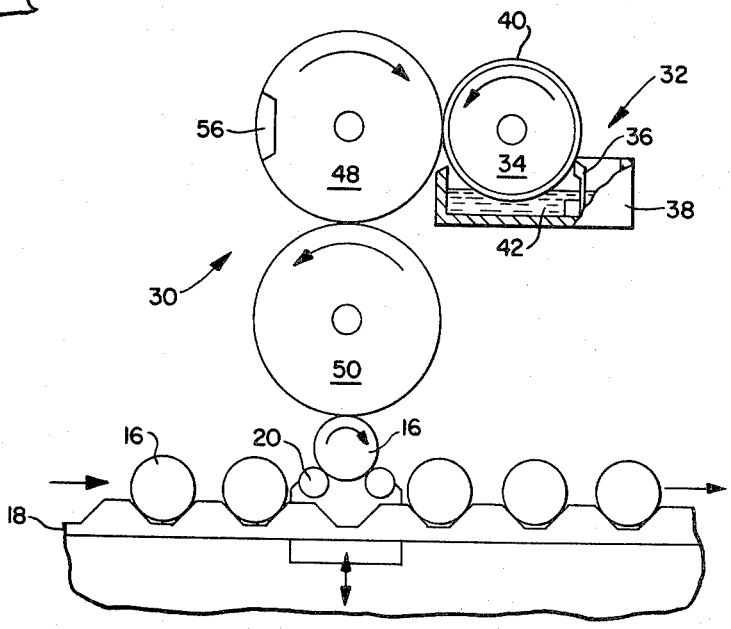
FIG. 2 is a schematic side view of a first embodiment of the present invention illustrating a horizontally oriented three-roller printer with single ink roll/doctor blade assembly ink-metering system.

The printer of FIG. 2 includes an ink metering assembly 32 comprising an ink roll 34 and a thin flexible doctor blade 36 suspended in an ink reservoir 38. The surface of the ink roll 34 is convered with a relatively soft elastomeric material 40 having a durometer hardness of between approximately 35 and 60 SHORE-A. The ink roll 34 is rotated through either paste or liquid ink 42 in the reservoir 38. The doctor blade 36, which may be of steel, is slightly preloaded and tensioned against the soft surface 40 of the ink roll so that the operator adjustments are unnecessary.

The relatively soft elastomeric covering 40 and doctor blade geometry of the present invention eliminate the severe streaking caused by harder rollers of conventional offset printers. Streaking usually occurs when harder rollers of, for example, knurled steel or very high durometer elastomers, trap particles between the roll surface and the doctor blade. In the present invention, small particles can deflect the soft roll surface 40 and slip under the doctor blade 36. Since there is no buildup of trapped particles, streaks are not formed on the ink roll 34. The interaction of the ink viscosity and roll motion develops a fluid pressure sufficient to lift the doctor blade 36 slightly. This provides the desired film on the ink roll without wear since the blade is hydroplaning.

Figure 3:
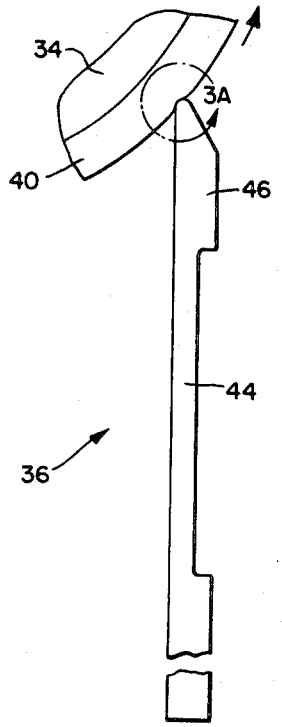
FIGS. 3 and 3A are schematic fragmentary views of the doctor blade configuration and orientation relative to the ink roll.
Figure 3A:
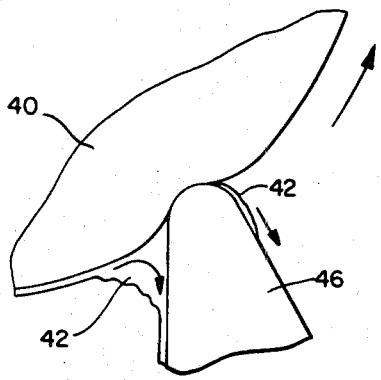

The doctor blade 36 is spring loaded against the ink roll 34 in a "following" angle configuration, as shown in FIG. 2, and more particularly in FIGS. 3 and 3A. A portion 44 of the doctor blade cross section is relatively thin. This allows the blade to be kept quite flexible with a low spring rate and thus will permit it to follow any roll runout with negligible change in blade pressure. The latter prevents the inking film from noticeably thinning at high runout points or thickening at low points.

The edge 46 of the doctor blade is not sharp but has a small radius of curvature to prevent large ink dragthrough buildup. The latter occurs when ink accumulates on the back (downstreaam) side of the blade. If the blade's edge has too large a radius of curvature, a large amount of ink may build up at this point. This is obviously undesirable since, whenever the printer comes to a stop, the ink buildup can sag and cling against the ink roll. When the roll begins to rotate again, this ink buildup may eventually reach and clog the stamp.

The doctor blade 36 of the present invention schematically illustrated in FIGS. 3 and 3A is particularly effective in eliminating the foregoing ink buildup problem. The blade 36 is oriented vertically and the edge 46 is below the ink roll axis. When the ink roll stops, the dragthrough ink buildup 42 will run or flow harmlessly away from the roll, as indicated by the arrows (FIG. 3A).

Figure 2A:
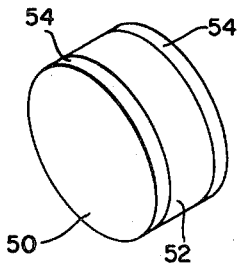
FIG. 2A is a schematic perspective view of the blanket or offset print roll of the printer in FIG. 2.

The printer 30 also includes a plate cylinder 48 and an offset print roll or blanket 50. The surface of the print roll 50 is smooth and at least a portion thereof is formed of a relatively soft elastomeric material 52, as shown in FIG. 2A. Conventional offset rolls or blankets are usually 35 SHORE-A durometer or harder and thus require excessive printing pressure. The elastomeric covering 52 for the blanket 50 of the present invention has a durometer hardness of between approximately 15 and 30 SHORE-A. This is more suitable for printing on the corrugated surface of a shotshell than are conventional harder blankets.

The blanket elastomeric material 52 need not cover the entire surface of the offset print roll 50 but only a strip of width necessary for the required printing. On either side of the blanket elastomeric covering 52 may be a harder urethane disc 54 to drive the shotshell and control the printing pressure applied. The blanket covering 52 will absorb the punishment of several feed jams without damage. If it does become worn in one spot, it can be rotated slightly to use a fresh surface.

Since most elastomers swell in the presence of almost any ink or solvent, careful matching of the elastomeric material selected for the ink roll 34 and blanket 50 is needed. Moreover, to minimize roller diameter changes that may require printer adjustments or, in extreme cases, regrinding, the elastomeric roll coverings should be kept relatively thin. In the case of the ink roll cover 40, a thickness of about 1/32 to $\frac{1}{8}$ inch has been found to be particularly effective.

The plate cylinder 48 contains the printing plate or stamp 56 having the image to be printed. The plate 56 may be of photopolymer material, which will provide high quality characters at a relatively low cost. Since the surfaces of the ink roll 34 and blanket 50 contacting the plate are elastomeric, metal stamps may also be used. Long-lasting steel printing dies are particularly well suited for high volume printing. In any event, since the plate 56 is well isolated from shell misfeeds, long stamp life is to be expected.

The operation of the printer 30 of FIG. 2 is quite simple. The shotshells 16 are fed to the printing station in a conveyor belt 18, as explained earlier in connection with the prior art printer-feeder assembly of FIG. 1. A thin, uniformly even ink film is formed on the ink roll 34 at the line of contact between the doctor blade 36 and elastomeric covering 40. The rolling contact between the ink roll 34 and the plate cylinder 48 transfers the ink film to the printing plate 56. The rolling contact between the plate cylinder and offset print roll 50 transfers the inked image to the elastomeric covering 52 of the blanket 50 which does the actual printing on the shotshell 16.

When the indexing conveyor belt 18 is used as a means for feeding shells 16 to the horizontally oriented printer 30 of the present invention, excessive ink buildup on the printing plate 56 and blanket may still occur whenever a skip or empty nest in the conveyor belt 18 occurs. This problem may be obviated by providing a means for deflecting the ink roll 34 from contacting the plate cylinder 48 whenever a skip occurs.

Figure 4:
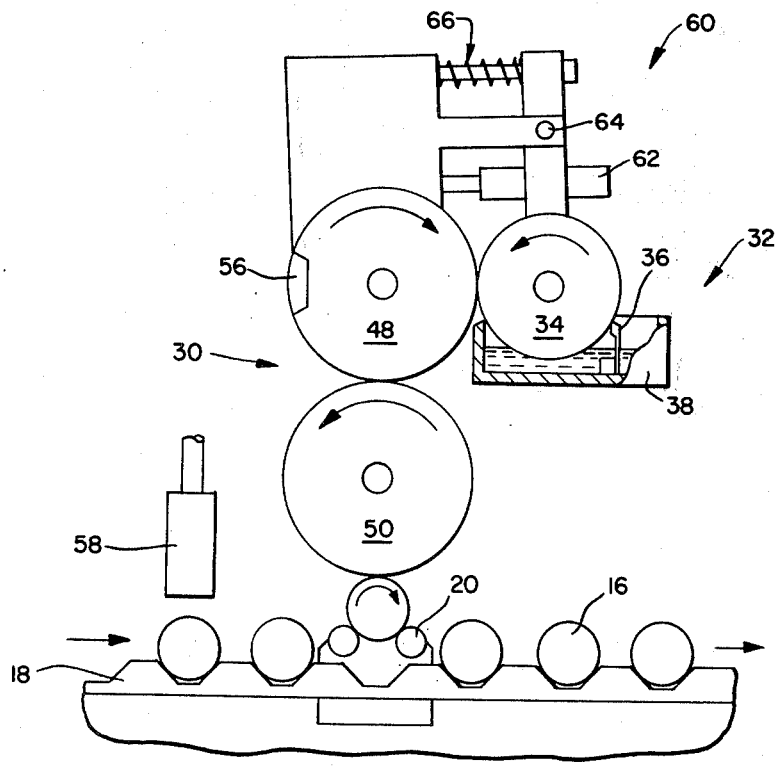
FIG. 4 is a schematic side view of another embodiment of the horizontal printer shown in FIG. 2 illustrating the ink roll deflector means.

FIG. 4 schematically illustrates another embodiment of the offset printer of the present invention, modified to include roll deflection means. A sensing means 58, such as a proximity sensor, is positioned along the conveyor belt 18 ahead of the printer 30. Sensor 58 will detect an empty nest or the absence of a shell and produce a signal which will actuate deflection mechanism 60 when the empty nest reaches the printing station. This may be controlled by pneumatic or hydraulic means by, for example, use of an air cylinder 62 responsive to the sensor signal. Actuation of the air cylinder 62 will cause the ink roll 34 to deflect slightly away from plate cylinder 48 about a pivot 64. The ink roll 34 returns to its contact position after about one revolution through the action of spring 66 as the air cylinder 62 is deactivated. Each skip deflects the ink roll from contacting the cylinder plate for a single revolution during which time an empty nest would be at the printing station. Unnecessary and excessive inking of the plates 56 and the blanket 50 when there is no shell to receive the inked image is thereby eliminated.

Skips and other printer feeding problems may be eliminated completely by the positive rotary transfer feed mechanisms illustrated in FIGS. 5–9, 12 and 13. The rotary transfer assemblies may be used to feed cylindrical objects such as shotshells oriented either horizontally or vertically during printing, as the situation requires.

Figure 5:
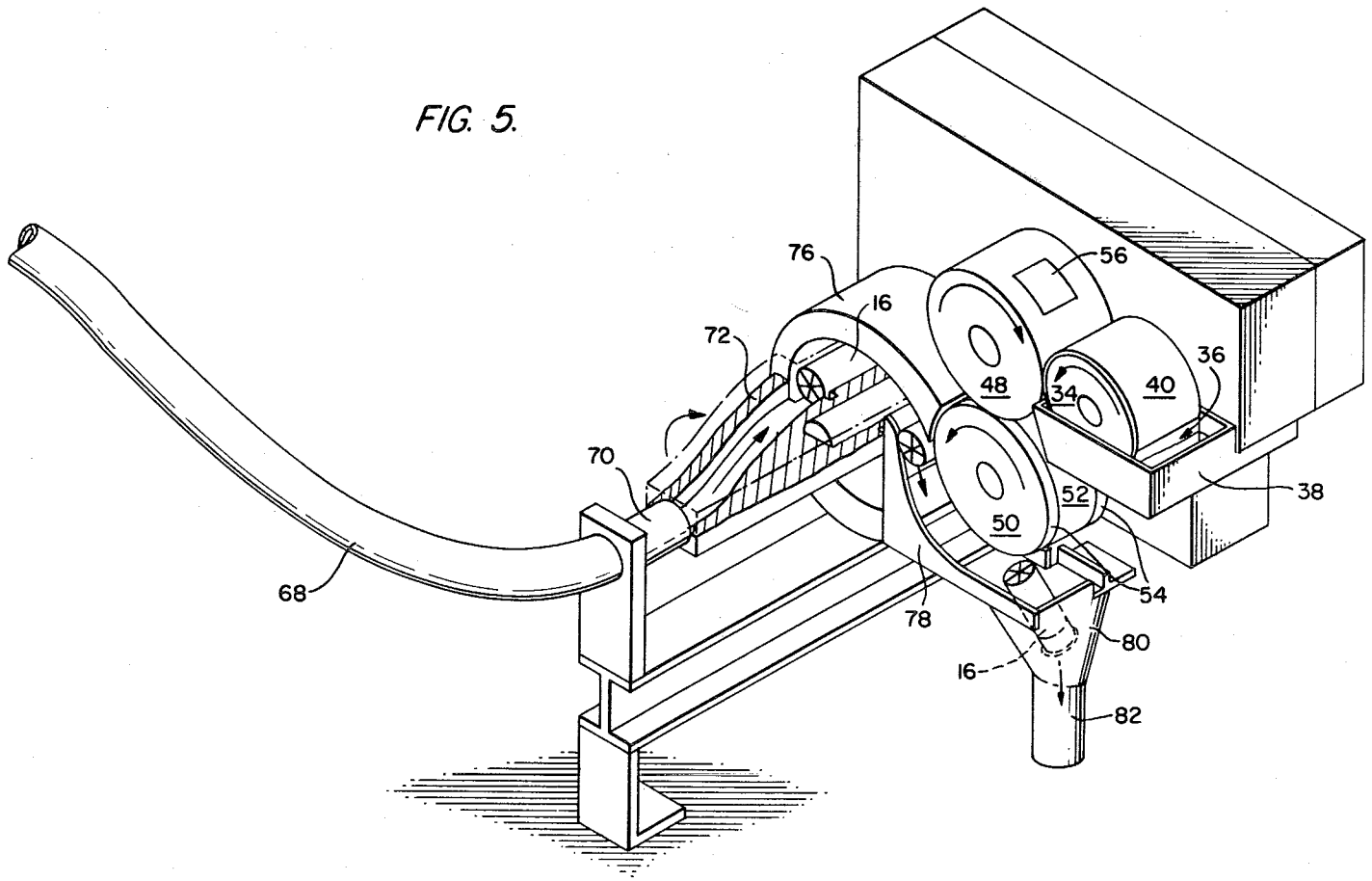
FIG. 5 is a schematic perspective view of the offset printer of the present invention in horizontal orientation illustrating the rotary transfer means for horizontally feeding shells to the printer.
Figure 12:
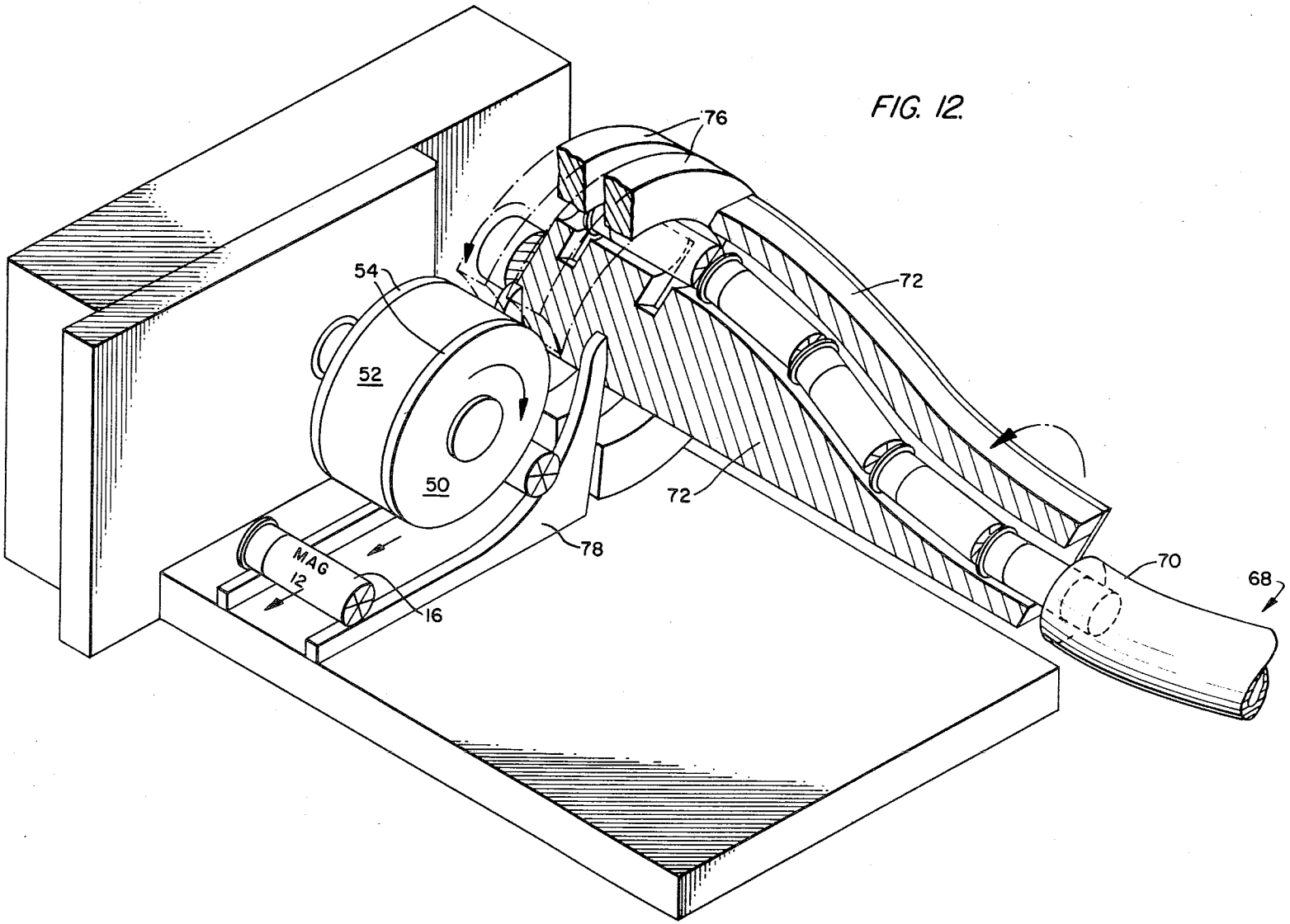
FIG. 12 is a perspective view of the rotary transfer feed and print roll assembly area illustrating the indexing of a column of shells as they are fed into the rotary feed.

FIGS. 5–6 and 12–13 illustrate the rotary transfer feed to a horizontal printer of the type described earlier in connection with FIG. 2, where like elements of the printer have the same reference characters. Shotshells 16, or other types of cylindrical containers, are fed into a stationary feed pipe 68, and the entrance end portion thereof may be oriented in any direction to accommodate the exit end of the prior production assembly station (not shown). The exit end portion 70 of the pipe 68 gradually bends to either the horizontal or vertical, depending upon the shell orientation desired at the printer. In FIGS. 5 and 12, the exit end 70 terminates horizontally at and aligns with a curved track 72 which rotates about the horizontal axis of the end portion 70 of the fixed feed pipe 68.

As explained above, shells 16 are fed into the fixed pipe 68, end to end, oriented cap first, and exit the pipe at 70 in a horizontal position. The shells slide down the curved track 72 as it rotates about its axis. An annular ledge or platform 74 (FIG. 13) at the bottom of the rotary track 72 rotates the first shell fed at the proper height and also serves as a stop for the column of shells being fed each time the column indexes. Guide rails 76 restrain the shell so that it will follow the circular arc of the rotary track 72, thereby providing the time required for the column to advance one shell and restraining the shell in the rotary track 72 as it sweeps around. Other guide rails 78 force the shell away from the circular path of the rotary track 72 and into the circular path of the offset print roll 50. The shells 16 roll against the rails 78 and the elastomeric covering 52 of blanket 50 as they receive the inked characters. The print roll 50 also rotates the shells during printing, as the harder urethane surface 50 on either side of the elastomeric cover 52 serves to drive the shotshell and control the printing pressure applied. The shells 16 then continue along the rails 78 for subsequent collection and processing by, for example, being fed into a funnel entrance 80 and down a vertical pipe 82 (FIG. 5).

Figure 7:
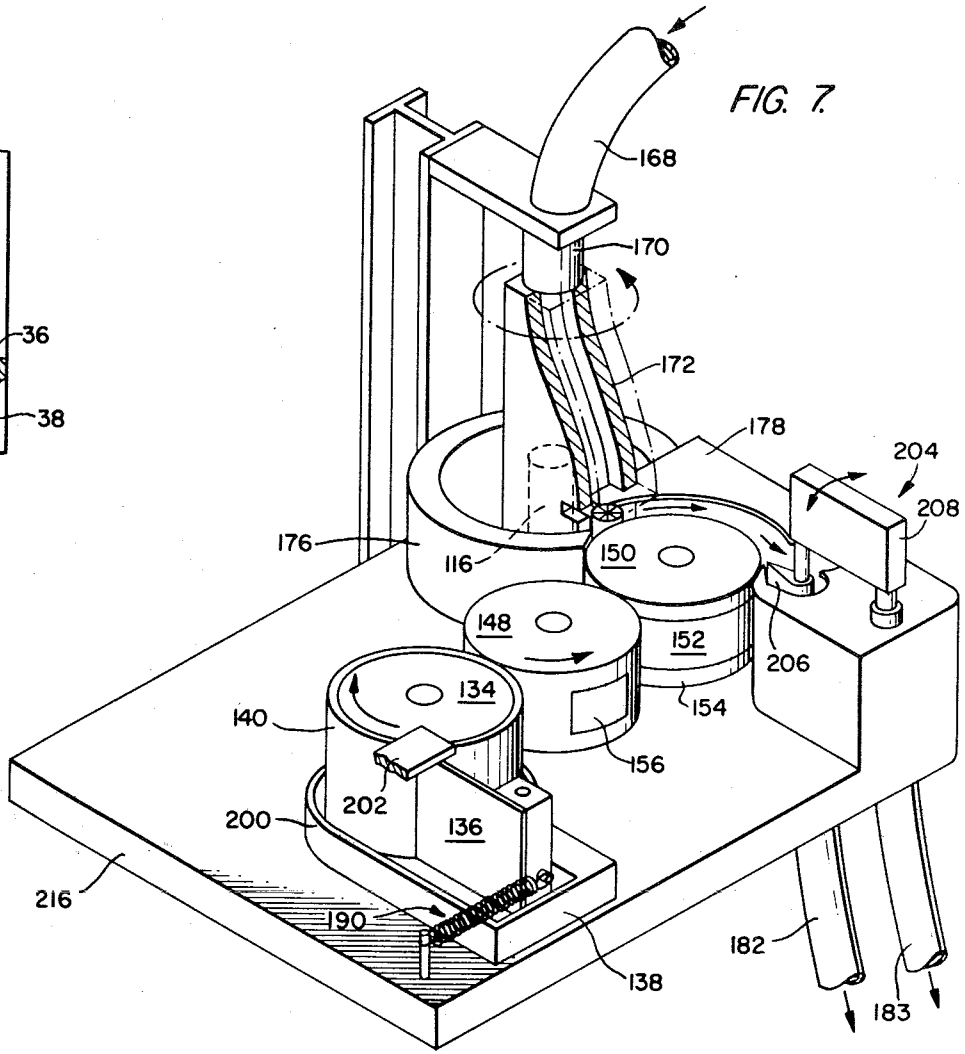
FIG. 7 is a perspective view of another embodiment of the present invention illustrating the rotary feeder/-printer vertically oriented.
Figure 6:
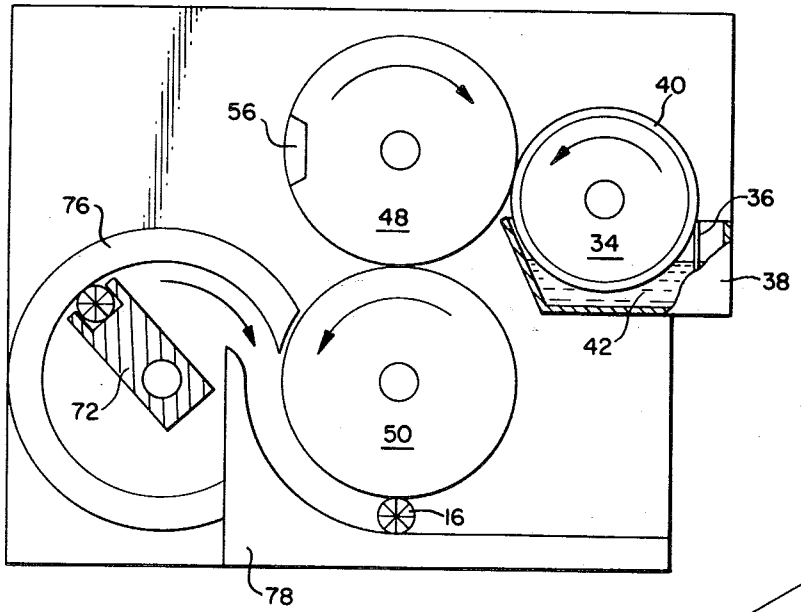
FIG. 6 is a schematic front view of the horizontal printer/feeder of FIG. 5 illustrating the relative position of the shells as they are fed to and around the rotary feeder.
Figure 9:
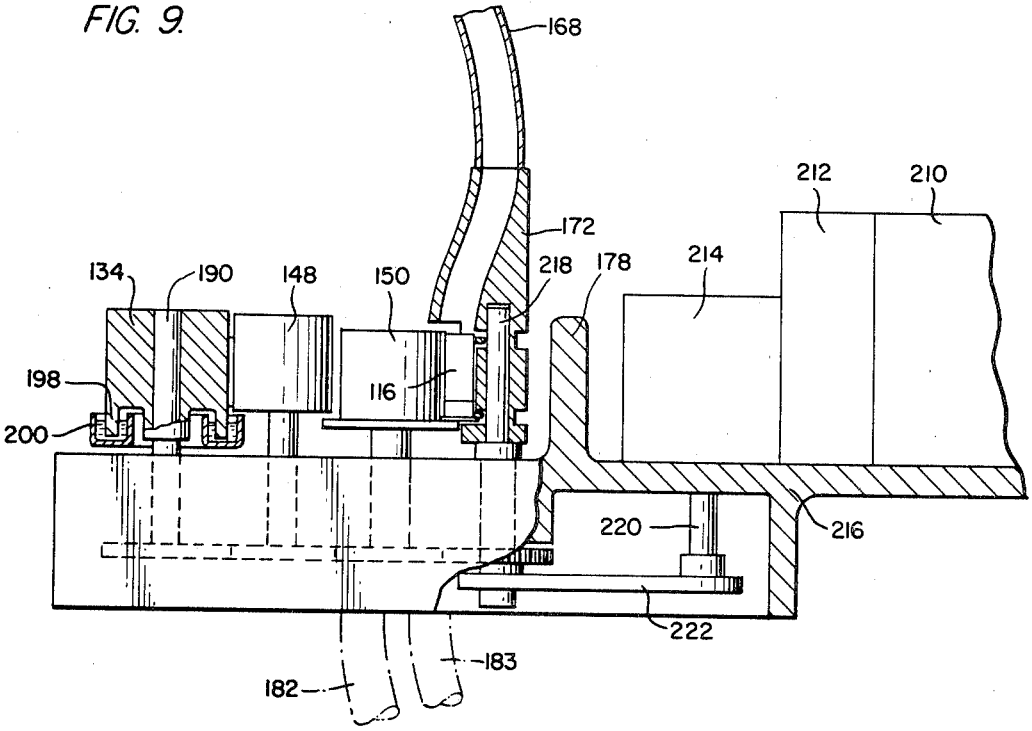
FIG. 9 is a cross-sectional view of a feeder/printer shown in FIG. 8 taken along line 9—9.
Figure 8:
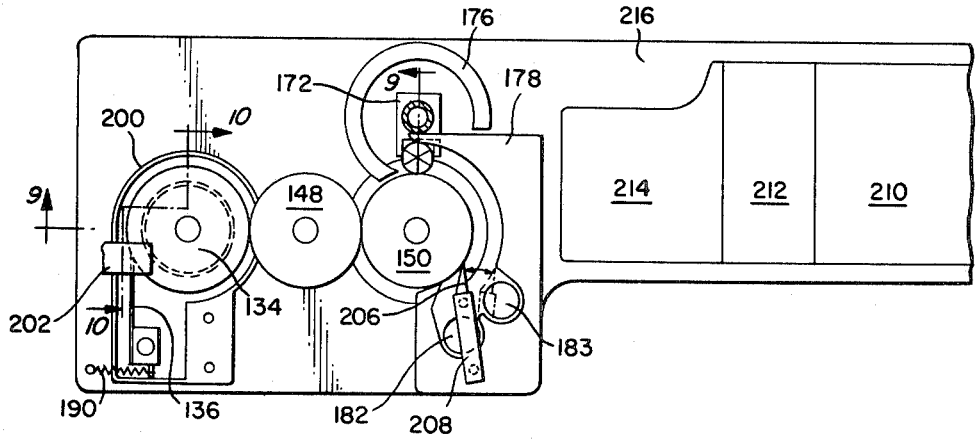
FIG. 8 is a partial top view of the feeder/printer of FIG. 7.
Figure 10:
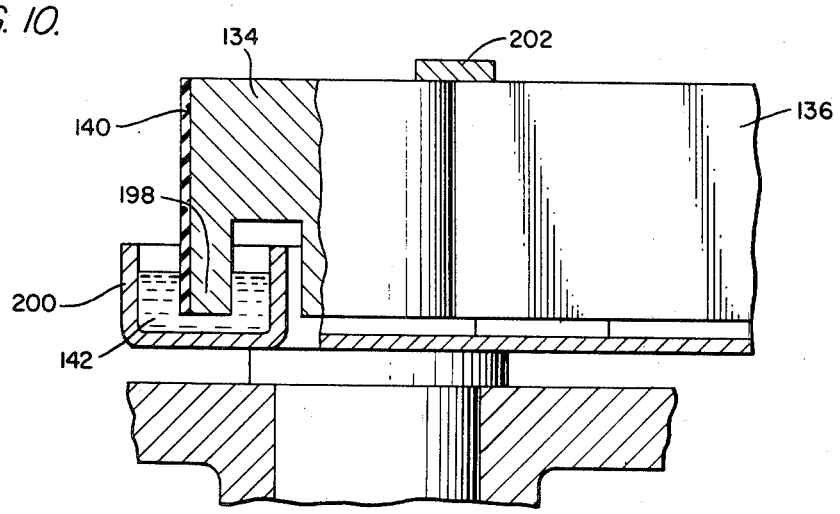
FIG. 10 is a partial cross-sectional view of the ink roll/doctor blade assembly employed in the vertical printer of FIG. 8 taken along line 10—10.

An example of a vertically oriented embodiment of the offset printer of the present invention is illustrated in FIGS. 7–9, with corresponding elements bearing the same last two digits as the reference characters for like elements of the horizontal printer described above. The ink roll 134, plate cylinder 148 and offset print roll 150 are shown in linear alignment. The stationary feed tube 168 and rotary track 172, and other elements of the rotary transfer feed of FIG. 7, are similar to those described earlier in connection with the horizontal rotary feed. Orientation is the principal difference between the rotary transfer feed assemblies.

The ink metering of FIG. 7, however, is different than ink metering assembly 32 described earlier in connection with FIG. 2 and used generally in the horizontal printer embodiments. When vertically oriented, the ink supply cannot be positioned readily to permit rotation of the ink roll 134 through the reservoir along its entire surface length prior to contact by the doctor blade 136, due to the force of gravity on the ink. The ink must be urged up along the surface line defined by contact of the ink roll and the doctor blade in order to evenly distribute the ink and force the thin ink film on the elastomeric surface covering 140 of the ink roll 134. Two methods for achieving this end are described herein, although other means employed for this purpose are also within the scope of this invention.

Figure 11:
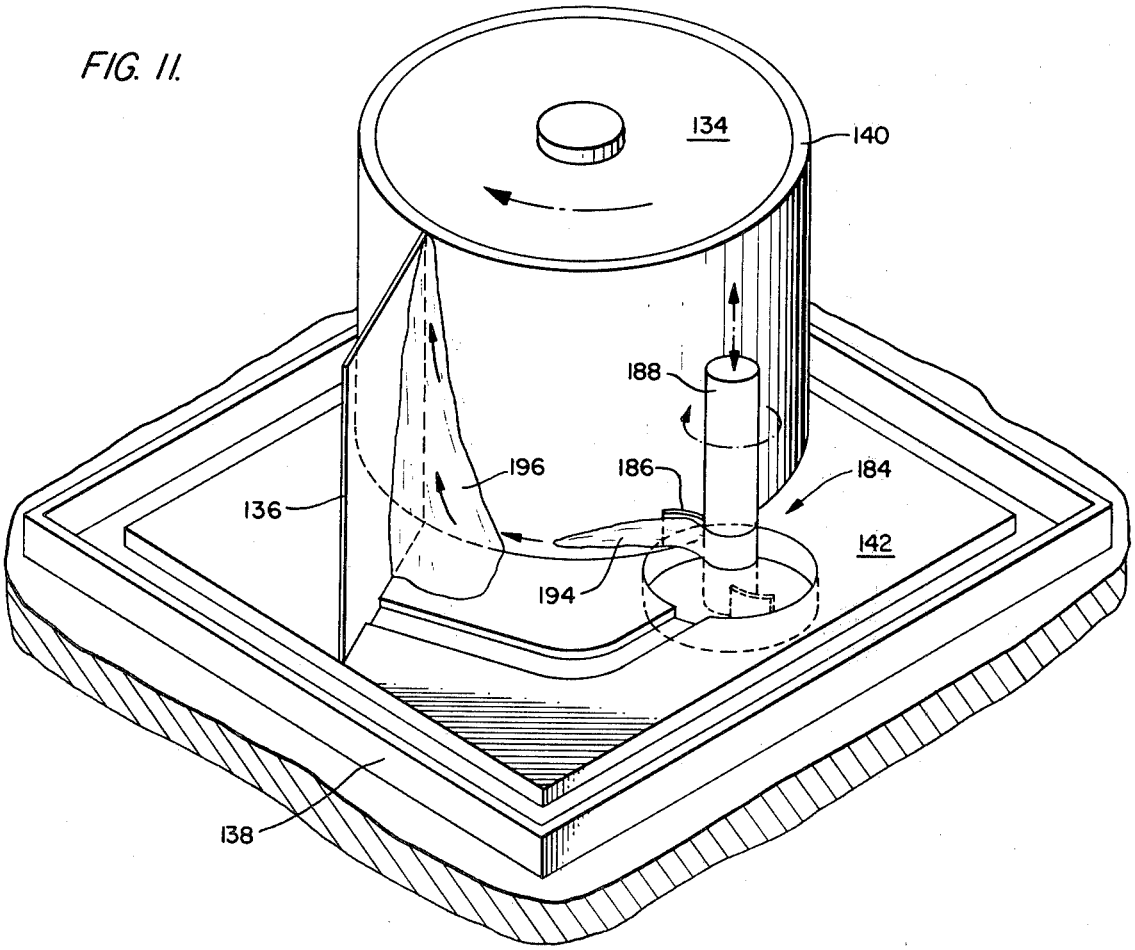
FIG. 11 is a partial perspective view of an alternative vertical ink roll/doctor blade assembly-metering system employing a recirculating pump.

FIG. 11 illustrates one method for vertical ink metering in accordance with the present invention employing a recirculating vertical pump 184 with an oscillating rubber paddle or wiper 186. The wiper is attached to the bottom of a vertical shaft 188 which is parallel to the ink roll shaft. The shaft may be driven to rotate by means of a pulley and O-ring belt drive (not shown). The shaft will also be made to reciprocate vertically by providing a cam bearing (not shown) and cam follower pins (not shown) on the shaft. The ink roll 134 and doctor blade 136 are disposed above the ink supply 142 in the reservoir 138. The doctor blade 136 is straight and flat and is disposed relative to the ink roll 134 in a fashion similar to the horizontal printer of FIG. 2, albeit in a vertical orientation. The doctor blade is slightly tensioned against the elastomeric covering 140 of the ink roll 134 by means of a spring 190 similar to that shown in FIGS. 7 and 8.

When the wiper shaft 188 is driven, it rotates and oscillates vertically as indicated by the arrows, causing the paddle wiper 186 to rise and apply a dab 194 of ink to the bottom of the ink roll 134. Each revolution of the pump shaft replenishes the wiper with excess ink which is deposited on the bottom of the ink roll. The ink dab carries to the doctor blade 136, where a puddle 196 of ink rapidly accumulates. Fluid viscosity and relative roll velocity, as well as the pressure of the blade 136 squeezing off excess ink, increase fluid pressure significantly enough to cause ink to rise vertically up the roll along the edge defined by the blade/roll contact to relieve the pressure. Sufficient ink is thus applied behind the doctor blade 136 for it to meter a smooth, even film onto the surface 140 of the roll 134, as in the case of and with the advantages noted earlier in the horizontally oriented metering system of FIG. 2.

The recirculating ink pump may be dispensed with completely when the peripheral lower end 198 of the ink roll 134 is suspended into an annular ink trough 200, as illustrated in the embodiment of FIGS. 7–10. The rotation of the ink roll 134 causes the ink 142 in trough 200 to climb up the roll 134 along the line of doctor blade 136 contact in a manner similar to that discussed above in connection with FIG. 11. This is made possible by the configuration of the lower end 198 of the ink roll to avoid ink leaks. Only the lower, outer peripheral end portion 198 of the ink roll rotates through the ink supply 142 in the annular trough 200. A seal block 202 at the top of doctor blade/ink roll intercept prevents ink from going up over the top of the blade and ink roll.

As noted earlier, feeding and printing on shells with the vertical printer of FIGS. 7–10 is otherwise similar to that described in connection with the pipe-rotary track feeder and three roll offset printer in the horizontally oriented embodiment. Another aspect shown in the vertical embodiment of FIGS. 7–9, which might also be applied to the horizontal printer, is the provision for a shell diverger after printing. Diverging the shell flow into two (or more) streams or columns is often necessary due to downstream requirements since the next in-line operation for shotshells (as well as other manufactured cylindrical objects) is typically inspection and/or packing. The rate at which the shells are fed and printed by the present invention, however, may be too rapid for these subsequent operations.

A diverter 204 such as shown in FIGS. 7–9 is used to accomplish the aforenoted division into two lines. The diverter 204 comprises a paddle 206 attached to an arm 208 that oscillates from side to side every cycle or rotation of the rotary track 172. The paddle 206 is positioned adjacent to the print roll and will guide each shell 116 alternatively to the entrance of either eject tube 182 or tube 183. The shells will alternately fall into one or the other of the eject tubes for further handling and collection.

The printers of the present invention are driven by conventional means which will not be discussed in great detail here since such drive means are well known in this and other arts. A motor 210, clutch-brake 212 and reducer 214 are shown mounted on the printer support frame 216. The rotary track 172 is driven by its shaft 218, which is connected to and driven by the reducer shaft 220 by means of linkage 222. The ink roll 134, plate cylinder 148 and print roll 150, as well as the shell diverter 204, are each respectively driven synchronously by shafts interconnected by gearing shown as dashed lines in FIG. 9.

Figure 14:
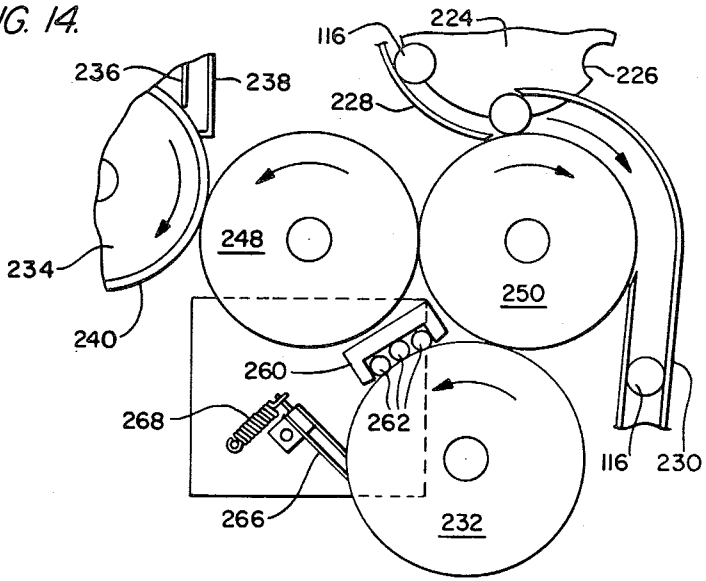
FIG. 14 is a schematic view of another embodiment of the printer illustrating the excess removal roll in friction rolling contact with the blanket roll.
Figure 15:
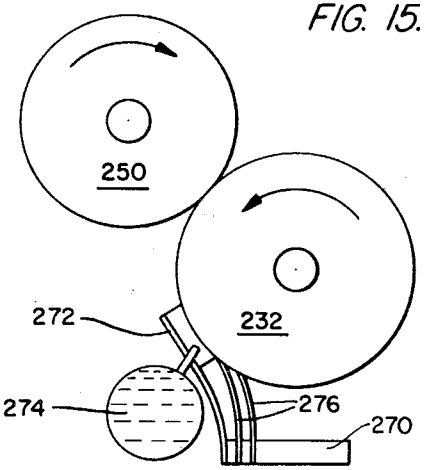
FIG. 15 is a schematic view of another means for cleaning the excess removal roll of FIG. 14.
Figure 13:
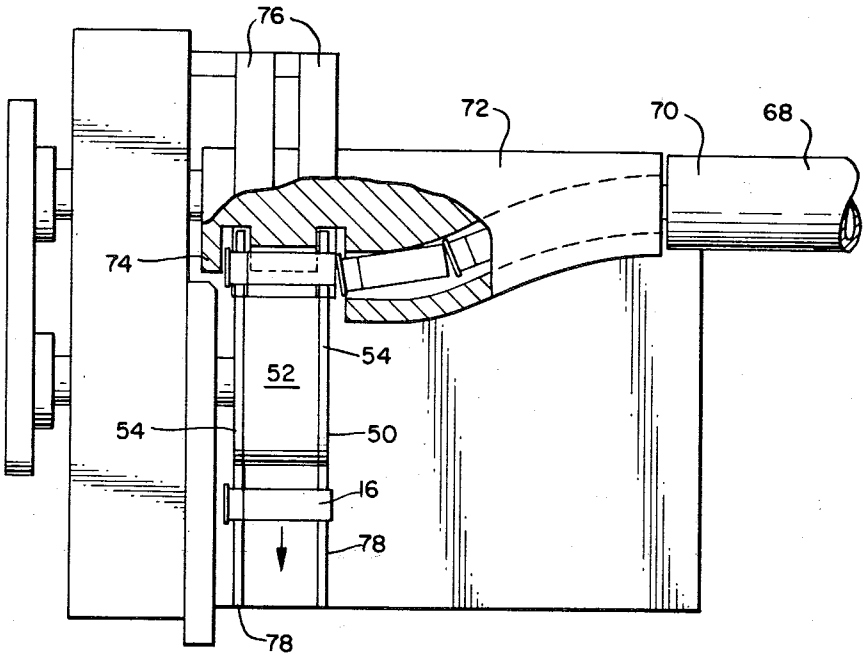
FIG. 13 is a plan view of the rotary feeder of FIG. 12.

Yet other means for feeding the shells to the printer and also removing excess ink from the blanket or ink roll are illustrated in the embodiments of the printer of FIGS. 14–15. The ink roll 234, plate cylinder 248 and print roll 250 are constructed and arranged in a manner similar to the printer embodiments previously discussed. In FIG. 14, the printer is shown vertically oriented and shells are fed to the print roll 250 by means of rotary disc 224 carrying shells in peripherally disposed pockets 226. The relative rotation of disc 224 and print roll 250 is such that, for every print roll revolution, the disc will move another shell-carrying pocket into contact position with the print roll. The shells are further guided to and away from the print roll 250 with the assistance of rails 228 and 230, respectively.

Prior inspection and rejection of shells may result in empty pockets 226 on the rotary disc 224 prior to reaching the print roll 250. This results in the excess ink problem on the print roll caused by shell skips described earlier. The problem may be minimized by providing an excess removal roll 232 in continuous rolling contact with the blanket or print roll 250. The excess removal roll 232 is a roller-bearing cylinder with a smooth, hardened outer surface in contact with and friction driven by the print roll 250. If a shell is not present in a pocket 226, excess ink applied to the blanket 250 will be transferred to the bearing surface of the removal roll 232 as the latter rotates in contact therewith.

The transferred excess ink is treated by a solvent applied by a wiper 260. A fast drying solvent, such as trichloroethelene, may be used and applied by felt pads 262. The solvent dilutes the ink on the removal roll and makes it easier to remove. The diluted ink is then removed by scraper blades 266 as the removal roll 232 continues to rotate. The scraper blades 266 may be made of teflon or spring steel and are spring loaded against the removal roll by spring 268. The scraper blades 266 remove the ink and solvent mixture from the bearing surface of removal roll 232, which is clear and dry by the time it again rotates into contact with the print roll 250.

FIG. 15 illustrates an alternative arrangement for the felt pads 272 and scraper blades 276. The pad 272 is provided with solvent from supply 274. Both the pads 272 and scraper blades 276 of FIG. 15 are mounted to the same support 270 and spring biased against the ink removal roll 232. The blades 276 are mounted in "reverse angle" orientation relative to the removal roll 232 for completely removing ink and solvent mixture from the surface of the removal roll.

While the particular embodiments of the invention have been described for purposes of illustration, it will be understood that various changes and modifications can be made therein within the spirit of the invention, and the invention accordingly is not to be taken as limited except by the scope of the appended claims.

I claim:

1. Vertical ink metering apparatus comprising:

a vertical ink roll having a smooth, soft surface of elastomeric material and adapted to rotate about its vertical axis, said lower end of the ink roll suspended in a supply of ink;

a stationary, annular ink trough containing said ink supply, the lower end of said ink roll being configured so that only the lower, peripheral end portion of the roll rotates through the ink supply in the trough; and a flexible doctor blade preloaded against the ink roll surface so that its edge contacts the surface along a vertical line parallel to its axis, whereby ink is applied as a thin, uniform film on the surface of the ink roll by the doctor blade as the ink roll rotates through the ink supply in the stationary, annular trough.

2. The ink metering apparatus of claim 1 wherein a sealing means is provided at the top of the vertical contact line to prevent ink from rising above the top of the blade and roll.

3. A printing apparatus including the vertical ink metering apparatus of claim 1 and further comprising:

a vertical plate cylinder which is inked by transfer of the ink film from said ink roll; and a vertical print roll which transfers the inked image from the plate cylinder to the printing surface.

4. The printing apparatus of claim 3 further comprising an ink removal roll in rolling contact with the print roll for removing excess ink on the print roll.

5. The printing apparatus of claim 3 wherein the excess ink removed from the print roll by the removal roll is further treated by a solvent and scraped from said removal roll prior to its again contacting said print roll.

6. Vertical ink metering apparatus comprising:

a vertical ink roll having a smooth, soft surface of elastomeric material and adapted to rotate about its vertical axis, said lower end of the ink roll disposed near a supply of ink;

a flexible doctor blade preloaded against the ink roll surface so that its edge contacts the surface along a vertical line parallel to its axis; and means for applying the ink to the surface at the lower end of the ink roll includes an oscillating wiper adapted to rotate as well as oscillate vertically, said wiper applying ink from the ink supply to the ink roll surface, whereby the ink will rise along the vertical contact line as the ink roll rotates and be applied as a thin, uniform film on the ink roll surface by the doctor blade.

7. A method for vertically metering a continuous uniform ink layer having a desired thickness onto a vertical roll of a printing apparatus comprising:

suspending the lower end of the roll in a supply of ink located in an annular ink trough;

rotating the roll about its axis while maintaining the annular ink trough stationary so that only the lower peripheral end portion of the roll is rotated through the ink supply in the annular trough;

preloading a vertical blade against said roll so that a vertical line of contact is made along the entire length of the roll;

applying ink to the cylindrical surface at the lower end of the roll as it rotates through the ink supply in the annular trough, said applied ink rising along the contact line between the roll and the blade; and lifting the edge of the blade slightly from the surface of the roll due to the accumulation of ink rising along the contact line and the action of roll rotation to evenly distribute said ink as a continuous uniform layer on said roll.

* * * * *